United States Patent [19]

Hirai et al.

[11] 3,943,319

[45] Mar. 9, 1976

[54] MICROWAVE OVEN WITH HINGED DOOR AND LATCH MEANS

[75] Inventors: Kazumi Hirai, Nabari; Yoshitomo Fujitani, Nara, both of Japan

[73] Assignee: Matsushita Electric Industrial Co., Ltd., Kadoma, Japan

[22] Filed: Feb. 24, 1975

[21] Appl. No.: 552,147

[30] Foreign Application Priority Data

Feb. 26, 1974 Japan ..... 49-23403

[52] U.S. Cl. ..... 219/10.55 D; 126/190

[51] Int. Cl.[2] ..... H05B 9/06

[58] Field of Search 219/10.55 D, 10.55 C, 10.55 E; 126/190, 191, 192, 193, 194, 200; 292/DIG. 12, DIG. 30, DIG. 69, DIG. 71

[56] References Cited

UNITED STATES PATENTS

| | | | |
|---|---|---|---|
| 3,484,573 | 12/1969 | Tingley | 219/10.55 D |
| 3,544,751 | 12/1970 | Valles | 219/10.55 D |
| 3,639,717 | 2/1972 | Mochizuki | 219/10.55 C |
| 3,678,238 | 7/1972 | Yasuoka et al. | 219/10.55 D |
| 3,715,552 | 2/1973 | Umezu et al. | 219/10.55 C |
| 3,715,554 | 2/1973 | Umezu et al. | 219/10.55 C |
| 3,733,456 | 5/1973 | Blackburn | 219/10.55 C |
| 3,756,219 | 9/1973 | Snyder | 126/191 |
| 3,767,884 | 10/1973 | Osepchuk | 219/10.55 D |
| 3,809,843 | 5/1974 | Takayama | 219/10.55 D |

OTHER PUBLICATIONS

McConnell et al., *A Dielectric Inserted Choke Seal for The Microwave Oven*, Journal of Microwave Power 5(3)70 pp. 183–187.

*Primary Examiner*—Arthur T. Grimley
*Attorney, Agent, or Firm*—Wenderoth, Lind & Ponack

[57] ABSTRACT

There is disclosed a microwave oven comprising a casing structure which defines a substantially triangular sectioned cavity and a hingedly supported door formed with a substantially triangular sectioned cavity. The cavity of the casing structure cooperates with the cavity of the hingedly supported door to define a complete heating chamber of substantially cubic body. The door is hinged at the top edge to the front edge of the top wall member of the casing structure.

8 Claims, 11 Drawing Figures

MICROWAVE OVEN WITH HINGED DOOR AND LATCH MEANS

The present invention generally relates to a microwave oven and, more particularly, to a microwave oven of a type comprising an oven-defining casing structure having a hingedly supported door adapted to be upwardly and downwardly moved for opening and closing, respectively, an access opening of the oven-defining casing structure with the hinge axis of said door substantially horizontally located adjacent the front edge of the top wall member which forms a part of the oven-defining casing structure, which door is hereinafter referred to as a "top-hinged" door for the sake of brevity.

A microwave oven having a hingedly supported door hinged to one of the front edges of respective side wall members of the oven-defining casing structure, which door is hereinafter referred to as a "side-hinged" door, and a microwave oven having a hingedly supported door hinged to the front edge of the bottom wall member of the casing structure, which door is hereinafter referred to as a "bottom hinged" door, are both well known and are now commercially available.

However, a microwave oven having a top-hinged door such as provided by the present invention has not yet been commercially available partly because a smooth movement, i.e., selective opening and closure, of the top-hinged door, the weight of which top-hinged door constantly acts in a downward direction during the opening of the door, can hardly be ensured without any difficulty and partly because a substantially complete prevention of microwave leakage is considered difficult.

On the other hand, it has been well recognized that the top-hinged door of the microwave oven has various advantages as compared with any of the side-hinged and bottom-hinged doors. One of these advantages is that, since the door does not project excessively frontwardly of the access opening of the oven-defining casing structure which leads into a heating chamber defined by said casing structure, the door can easily be handled within a limited space for installation of the microwave oven; another advantage is that, when the door is fully opened to an extent that at least an upper portion of the access opening of the oven-defining casing structure diagonally upwardly confronts the direction of sight of the user of the microwave oven, the user can readily check a heated condition of a material being heated within the oven-defining casing structure without being compelled to frequently remove the material being heated out of the oven-defining casing structure; and a further advantage is that the microwave oven can be manufactured in a more compact size than the microwave oven having either the side-hinged door or the bottom-hinged soor if the top-hinged door is designed such as to form a part of the heating chamber.

In order for the microwave oven having the top-hinged door to be manufactured and subsequently made commercially available, the top-hinged door should be designed such as to cancel the weight of the top-hinged door itself so that no substantial weight of the top-hinged door affect the movement of the top-hinged door between opened and closed positions, but upwardly acting pulling and downwardly acting pushing forces selectively applied by the user of the microwave oven substantially open and close the top-hinged door, respectively.

Moreover, if a container having a relatively great height, such as a bottle or the like utensil, which accommodates therein material to be heated or otherwise heat-treated, is inserted into the heating chamber of the oven-defining casing structure and the top-hinged door of the casing structure is to be subsequently closed, the top-hinged door will not completely close the access opening leading to the heating chamber, or otherwise is liable to damage upon forcible application of the downwardly acting pushing force in an attempt to close the door. Therefore, the microwave oven of the type having the top-hinged door should be provided with means for preventing the door from being broken in this way.

Furthermore, because of the nature of the microwave oven wherein radiation of hazardous microwaves takes place, development of microwave leakage preventing means including a door handle, a door locking mechanism and related components, all suited to the microwave oven having the top-hinged door, is one of the most important factors to consider.

Accordingly, an essential object of the present invention is to provide a microwave oven comprising an oven-defining casing structure having a top-hinged door, a portion of which door is substantially outwardly concaved to define a substantial half of a heating chamber when said door is in a closed position, so that the overall size of the microwave can be made smaller than the conventional microwave oven having either the bottom-hinged door or the side-hinged door with no substantial reduction in the effective volume of the heating chamber.

Another important object of the present invention is to provide the microwave oven of the type referred to above, wherein means is provided for cancelling the weight of the top-hinged door thereby to facilitate a smooth movement of the door between the opened and closed positions only by the substantial application of upwardly pulling and downwardly pushing forces, respectively, so that any possibilities that the door in its opened position tends to move towards the closed position by its own gravity and that the user of the microwave oven has her finger or fingers jammed by the door then rashly moved to the closed position by its own gravity can advantageously be avoided.

A further object of the present invention is to provide the microwave oven of the type referred to above, wherein a door locking mechanism is associated with a door handle so that opening of the door does not substantially require separate and independent operating procedures of releasing the door locking mechanism and upwardly pulling of the door handle, said opening of which door is carried out by touching the door handle and subsequently upwardly pulling the door handle in a usual manner.

A still further object of the present invention is to provide the microwave oven of the type referred to above, wherein the top-hinged door can halt in a substantially half-opened condition as desired during its movement between the closed and opened positions.

A still further object of the present invention is to provide the microwave oven of the type referred to above, which substantially eliminates any possibility that, if a container having a greater height than the effective height of the heating chamber of the microwave oven, such as a bottle or the like utensil, which accommodates therein material to be heat-treated, is inserted into the heating chamber, the container would be thrown down, or otherwise broken, upon closure of said door and/or the top-hinged door would be damaged to such an extent as to allow leakage of hazardous microwaves.

A still further object of the present invention is to provide the microwave oven of the type referred to above, wherein means is provided for forcibly opening upon opening of the top-hinged door an electrical power supply circuit for a microwave generator which has been energized.

A still further object of the present invention is to provide the microwave oven of the type referred to above, wherein the above mentioned means is an electrical ON-OFF switch and wherein means is provided for avoiding a complete closure of the top-hinged door while a foreign matter, such as a spoon, is jammed in between the door and the casing structure whereby said switch is maintained in an OFF condition unless the door is otherwise completely closed.

A still further object of the present invention is to provide the microwave oven of the type referred to above, wherein the top-hinged door is provided with means for absorbing portion of the radiated microwaves which remains unattenuated thereby to ensure a substantially complete microwave leakage prevention.

A still further object of the present invention is to provide the microwave oven of the type referred to above, which has a handsome looking appearance and can readily and easily be cleaned to avoid a possible pile-up of food particles within the heating chamber of the microwave oven.

A still further object of the present invention is to provide the microwave oven of the type referred to above, which can be manufactured in a more compact size than the conventional microwave oven having the side-hinged or bottom-hinged door, without substantially incurring unreasonable increase of the manufacturing cost.

In order to achieve the foregoing objects of the present invention, according to the present invention, there is provided a microwave oven comprising an oven-defining casing structure having a hingedly supported door adapted to be upwardly and downwardly moved for opening and closing, respectively, an access opening of the oven-defining casing structure. The access opening lies on the inclined plane which substantially confronts the direction of sight of the user of the microwave oven so that the interior of the casing structure can be viewed from frontwards and above the microwave oven, and therefore the interior of the casing structure is of substantially triangular section.

On the other hand, the hingedly supported door is formed with an outwardly concaved, substantially triangular sectioned cavity, which cavity, when the door is closed, cooperates with the substantially triangular sectioned interior of the casing structure to provide a complete heating chamber of substantially cubic body. This door is, according to the present invention, hinged at its top edge to the front edge of the top wall member forming a part of the casing structure, with the hinge axis substantially horizontally extending between the respective planes of side wall members of the casing structure.

These and other objects and features of the present invention will become apparent from the following description taken in conjunction with preferred embodiments of the present invention with reference to the accompanying drawings, in which.

Before the description of the present invention proceeds, it should be noted that like parts are designated by like reference numerals throughout the accompanying drawings.

Figure 1:
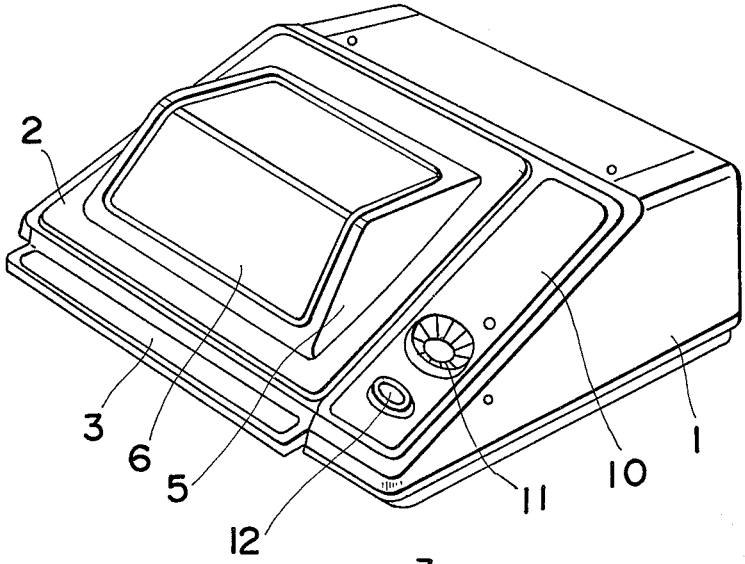
FIG. 1 is a perspective view of a microwave oven embodying the present invention.
Figure 2:
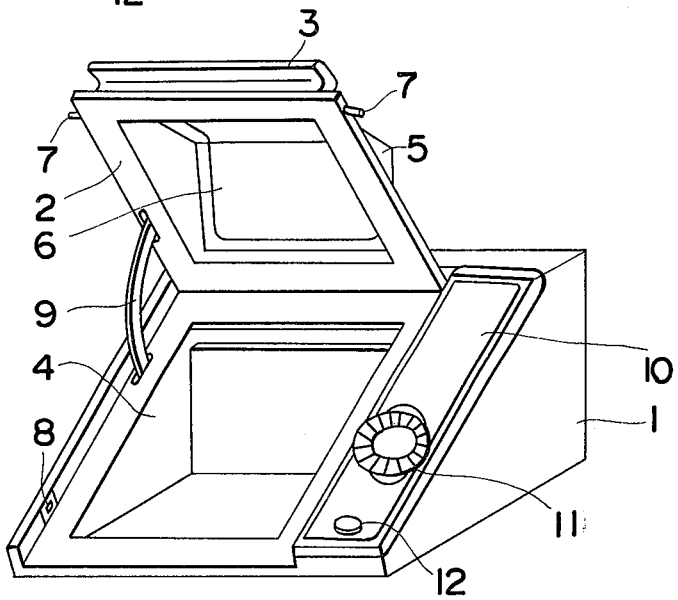
FIG. 2 is a similar view to FIG. 1, showing a top-hinged door in an opened condition.

Referring now to FIGS. 1 and 2, a microwave oven comprises a casing structure 1 which defines one of halves of a heating chamber, as designated by 4, and a door 2 formed with an outwardly concaved cavity 5 which defines the other of said halves of said heating chamber. As will be described later, when the door 2 is closed, the cavity 5 and the interior 4 of the casing structure in cooperation therewith defines a complete heating chamber of substantially cubic body.

Figure 5:
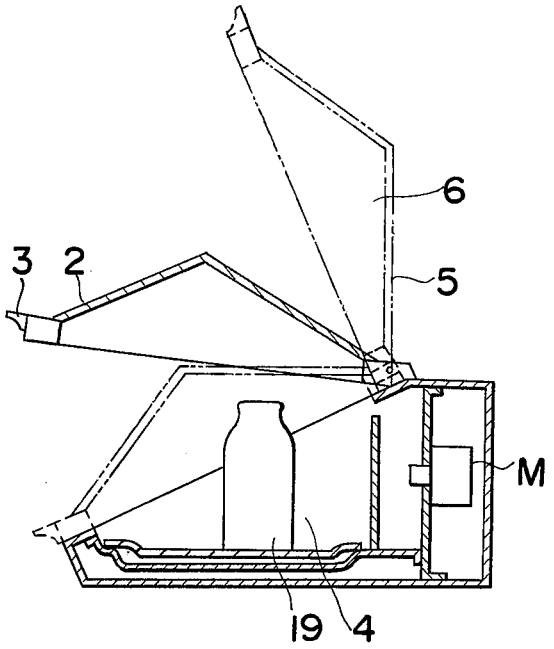
FIGS. 5 and 6 are side sectional views of the microwave oven employing a modified version of the door support mechanism.

The casing structure 1 may be of double walled structure and includes a high frequency wave generator or a magnetron assembly, indicated by M in FIG. 5, arranged in said casing structure in any known manner. As best shown in FIG. 2, the casing structure 1 has an access opening leading to the interior 4 of the casing structure 1 and adapted to be selectively closed and opened by the door 2, the plane of which access opening lies on the inclined plane which substantially confronts the direction of sight of the user of the microwave oven so that the interior 4 of said casing structure 1 can be viewed from frontwards and above the microwave oven when the door 2 is fully opened. The outwardly concaved portion of the door 2 which defines the cavity 5 is formed with a plurality of perforations arranged in any suitable pattern to provide an observation window 6 through which the complete heating chamber, defined by the interior 4 and the cavity 5, can be viewed from the outside of the microwave oven even though the door is closed.

Referring to FIGS. 2, 3, 5 and 6, the door 2 in the closed position has a top edge hingedly connected as at 13 to the front edge of the top wall member forming a part of the casing structure 1 whereby said door 2 can be pivotable about the hinge axis 13 upwardly and downwardly for selective opening and closing the access opening, respectively. The door 2 has a door handle 3 pivotally carried thereby, which door handle 3 is operatively associated with a door locking mechanism of a construction as will be described later. However, for facilitation of understanding of the subsequent description, it be understood that the door handle 3 is pivotable between locked and released positions and that latches 7, operatively carried by the door 2 and projecting from both sides of said door 2 in opposite directions with respect to each other, each of which latches 7 is movable between projected and retracted positions, are associated with said door handle 3 in such a manner that, when said door handle 3 is in the locked position, said latches 7 are outwardly projected, when the door is closed, into engagement with corresponding detent recesses, only one of which is shown by 8 in FIG. 2, to firmly lock the door 2 in the closed position, disengagement of said latches 7 from said respective detent recesses 8 being carried out by pivoting the door handle 3 to the released position.

Although not shown, an electrical ON-OFF switch, preferably, in the form of a microswitch, which is inserted in a known electric power supply circuit for the magnetron assembly M, is arranged in the casing structure 1 in position to be turned on by one of the latches 7 which are then engaged into the respective detent recesses 8. The magnetron assembly M can be energized to generate microwaves into the heating chamber when a start button 12 is, during closure of the ON-OFF switch, operated after a timer 11 has been set to a desired cooking time, said start button 12 and said timer 11 being disposed on an inclined control panel 10 which forms a part of the casing structure 1 and which lies on the same plane as the access opening of the casing structure.

Figure 3:
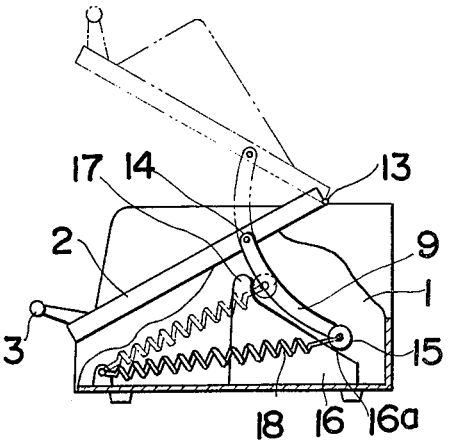
FIG. 3 is a side view of the microwave oven, with a portion broken away to show a door support mechanism.
Figure 4:
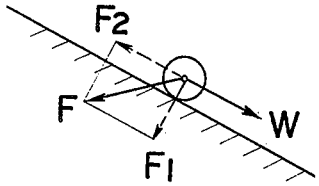
FIG. 4 is a schematic vector diagram used to explain the principle of operation of the door support mechanism employed in the microwave oven according to the present invention.

Referring now to FIGS. 2 to 4, there is shown a door support mechanism which comprises a curved door arm 9 having one end pivotally connected to the door by means of a pin 14 and the other end rotatably mounted with a roller 15, a substantially interpediate portion of said door arm 9 loosely extending into the double-walled casing structure 1 as best shown in FIG. 2. The roller 15 rests on an inclined surface 16*a* of a support block 16 rigidly mounted on the bottom wall member of the casing structure and within the casing structure 1. The support block 16 is of a substantially triangular shape and has a top apex portion formed into a stopper 17 which restricts movement of the roller 15 and which, at the same time, defines the opened position for the door 2. More specifically, the support block 16 is so designed as to allow the roller 15 to roll up the inclined surface 16*a* towards the stopper 17 as the door is pivoted about the hinge axis 13 towards the fully opened position as indicated by the double dotted chain line in FIG. 3, and also to roll down the inclined surface 16*a* as said door is pivoted about the hinge axis 13 towards the closed position as indicated by the solid line in FIG. 3. It is to be noted that, when the door is in the fully opened position, the roller 15 carried by the door arm 9 is restricted by the stopper 17 as shown by the double dotted chain line in FIG. 3.

The door support mechanism further comprises a tension spring 18 so suspended between a portion of the door arm 9 adjacent the roller 15 and a portion of, for example, the bottom wall member of the casing structure 1 that the roller 15 is biased towards the inclined surface 16*a* to keep a constant contact with said inclined surface. Preferably, the inclined surface 16*a* such an effective length that, when the roller 15 is restricted by the stopper 17 after having rolled up said inclined surface, the door 2 can be held in the opened position with the plane of said door situated above the level of the top wall member of the casing structure.

With particular reference to FIG. 4, a relationship between the weight of the door 2 and a pulling force exerted by the tension spring 18 will now be described.

In FIG. 4, reference characters A and B represent the axis of rotation of the roller 15 and the inclined surface 16*a*, respectively. Reference characters F and W represents an axially pulling force exerted by the tension spring and the weight of the door 2 which has been imposed on the roller 15 through the door arm 9. From the vector diagram of FIG. 4, it will readily be seen that the axially pulling force F of the tension spring 18 can be divided into two vector components; one being a force $F_2$ acting in parallel to the inclined surface B so as to move the roller 15 upwardly of said inclined surface B and the other being a force $F_1$ acting in a direction normal to the plane of the inclined surface B so as to pull the roller 15 in a direction perpendicular to the plane of the inclined surface B.

If the tension spring 18 is selected so as to have a axially pulling force F, the force $F_2$ of the vector component of which is substantially in equilibrium with the weight W, the user of the microwave oven of the present invention can easily open and close the door 2 without substantially feeling the weight of the door 2 which may otherwise be imposed on her or him through her or his hand in touch with the door 2. Moreover, since the weight of the door 2 is cancelled by the tension spring 18 so selected as hereinbefore described, the door 2 can halt anywhere as desired between the opened and closed positions.

Figure 6:
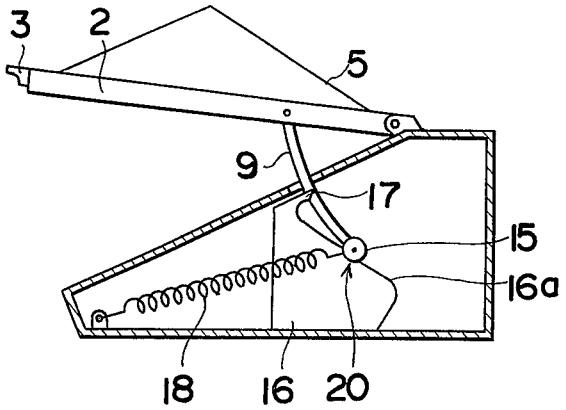

Referring to FIGS. 5 and 6, the top-hinged door 2 may have an intermediate position or a substantially half opened position as indicated by the solid line in FIGS. 5 and 6. It is to be noted that in FIGS. 5 and 6, the double dotted chain line and the chain line represent the door in the fully opened position and the door in the closed position, respectively.

In order that the top-hinged door 2 can halt at the substantially half opened position as shown, a rounded recess is formed, as shown by 20 in FIG. 6, on the inclined surface 16*a* of the support block 16 for trapping the roller 15 thereinto during the movement of the door between the closed and opened positions. The position of the rounded recess 20 on the inclined surface 16*a* is selected so that the door 2 in the half opened position provides an effective access opening of a height H though which material to be heat-treated can be effectively inserted into the heating chamber of the microwave oven, which height H is substantially equal to or slightly greater than the height h of the heating chamber which is formed when the door 2 is closed. This is particularly advantageous in that, when the door is in the half opened position, insertion of any container or like kitchen utensil having a height greater than the height *h* of the heating chamber, into the heating chamber can be avoided.

While the top-hinged door 2 is in the half opened position in the manner as hereinbefore described, subsequent or continued application of the upwardly pulling force to the door handle 3 causes the door 2 to pivot towards the opened position, at which time the roller 15 escapes from the rounded recess 20 on the inclined surface 16*a* of the support block 16.

The door locking mechanism will now be described with reference to FIGS. 7 to 9. Before the description proceeds, it should be noted that, partly because the door locking mechanism may not be provided on both sides of the door handle 2 and partly because, if door locking mechanisms are provided on both sides of the door handle 2, they are of the same construction, only one of which will be described.

Figure 7:
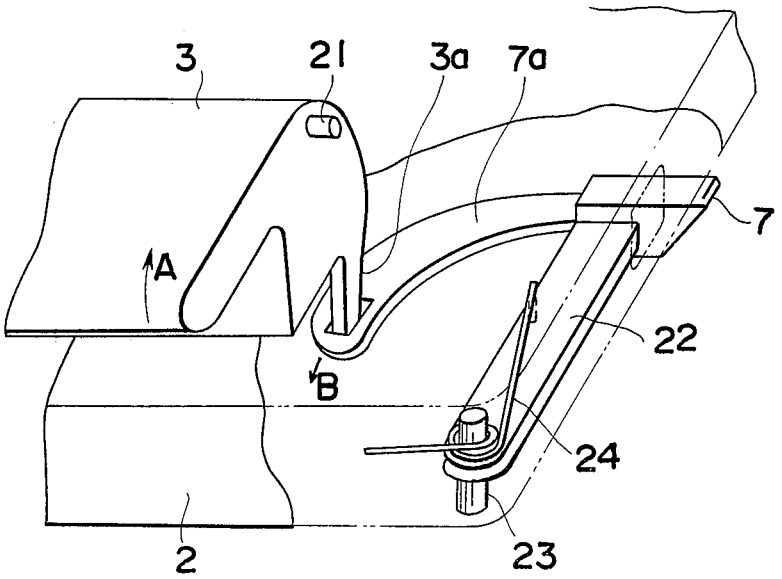
FIG. 7 is a schematic perspective view of a portion of the top-hinged door, showing a door locking mechanism.

Referring first to FIG. 7, the door locking mechanism includes a carrier lever 22 having one end rigidly mounted with the latch 7 and the other end pivotally carried by the door 2 by means of a pin 23. This carrier lever 22 is biased by a spring element 24, for example, a coiled spring, so that the latch 7 is held in the projected position. The latch 7 is also connected to the handle 3 by means of a connecting arm 7*a* which has one end connected to the latch 7 and the other end loosely receiving a leg portion 3*a* of the handle 3. It will readily be seen that, if the handle 3 is upwardly pivoted about a pin 21 in a direction indicated by in an attempt to open the top-hinged door 2, the connecting lever 7*a* can be frontwardly pulled with the carrier lever 22 pivoting against the spring element 24. Therefore, the latch 7 can be moved from the projected position to the retracted position in readiness for opening of the top-hinged door 2. When the upwardly pulling force that has been applied to the door handle 3 to move the latch 7 from the projected position to the retracted position is released, the latch 7 can automatically move up to the projected position by the action of the spring element 24.

Figure 8:
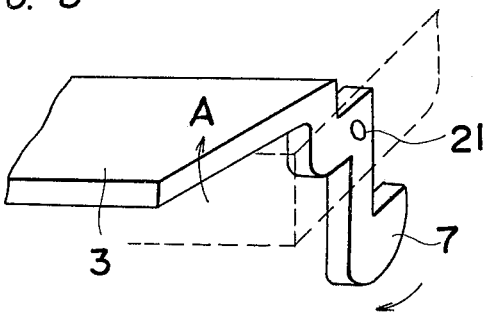
FIGS. 8 and 9 are schematic perspective views of respective modified versions of the door locking mechanism.

A modified version of the door locking mechanism is shown in FIG. 8. In FIG. 8, the latch 7 is integrally formed with the door handle 3 and is movable in the direction as indicated by the arrow-headed line as the handle 3 is upwardly pulled in an attempt to open the top-hinged door 2.

Figure 9:
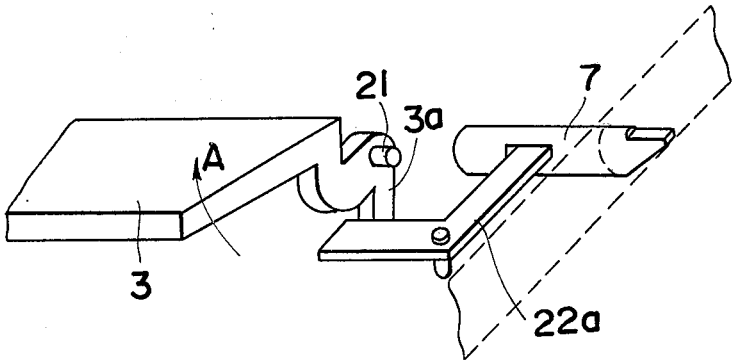

Another modified version of the door locking mechanism shown in FIG. 9 includes a substantially L-shaped lever 22*a* having one end carrying the latch 7 and the other end in engagement with the leg portion of the door handle 3, a substantially intermediate portion of which is pivotally carried by the top-hinged door 3. It will readily be seen that, as the door handle 3 is upwardly pulled in the direction A, the lever 22*a* pivots counterclockwise with the latch 7 moved to the retracted position. Although not shown in FIG. 9, it is to be understood that the spring element similar to the coiled spring shown in FIG. 7 is also employed to biase the lever 22*a* with the latch 7 held in the projected position.

Figure 11:
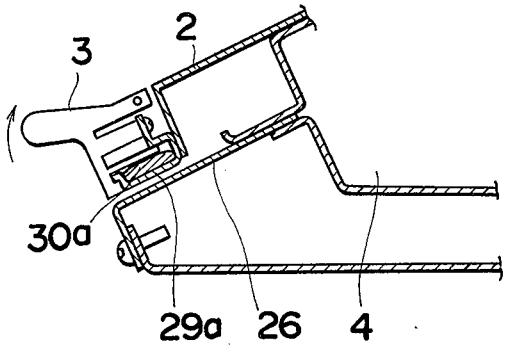
FIG. 11 is a similar view to FIG. 10, showing a modified method of positioning a microwave absorbing element.
Figure 10:
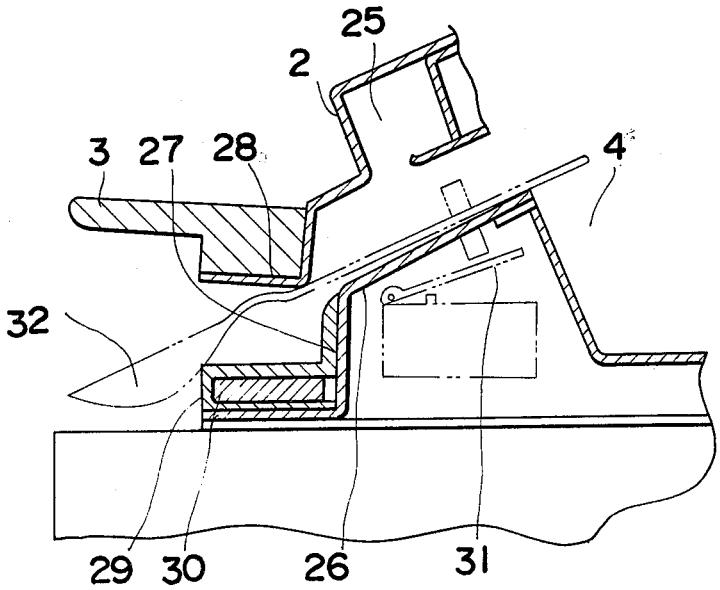
FIG. 10 is a side sectional view, on an enlarged scale, of a portion of the microwave oven, showing a method of positioning a microwave absorbing element.

Means for avoiding microwave leakage is shown in FIGS. 10 and 11.

Referring to FIG. 10, the top-hinged door 2 is formed at a portion adjacent the front thereof with a choke cavity 25 which serves to attenuate microwaves radiated by the magnetron assembly M. On the other hand, a portion of the casing structure 1 adjacent the choke cavity 25 has a front panel 26 which bridges between inner and outer walls of the double walled casing structure 1. The front panel 26 is stepped at 27 in a substantially zig-zag manner while a corresponding portion of the top-hinged door 2 is stepped at 27 to conform to the sectional contour of the stepped portion 27 of the casing structure 1. A microwave absorbent element, for example, a strip of ferrite rubber, is lined as at 30 through a covering 29 which encircles said microwave absorbent element and which is made of material of low dielectricity. Beneath the front panel 26 and within the double-walled casing structure 1, there is provided a normally closed door switch which is opened only when the door 2 is opened and, hence, the door 2 is not completely closed.

Since respective portions at the front of the top-hinged door 2 and the casing structure 1, where the door 2 and the casing structure 1 contact to each other, are shaped such as hereinbefore described, it will readily be seen that even if a foreign matter, for example, a spoon shown by the imaginary line 32, is jammed between the door 2 and the casing structure 1 as shown in FIG. 10, no door switch 31 is closed and, therefore, the microwave oven will not operate.

Referring to FIG. 11, the front panel 26 in the instance as shown lies on the plane parallel to the plane of the access opening of the casing structure 1. A microwave absorbent element 20 covered by a covering 29 made of low dielectric material is provided within a space which is formed between the door handle 3 and the front edge of the top-hinged door 2.

Although the present invention has been fully described by way of example with reference to the accompanying drawings, it should be noted that various changes and modifications are apparent to those skilled in the art. Therefore, such changes and modifications should be construed as included within the true scope of the present invention unless they depart therefrom.

What is claimed is:

1. A microwave oven having a magnetron assembly which radiates microwaves into a heating chamber, which comprises a casing structure having an access opening leading into a cavity defined by said casing structure; a hingedly supported door hinged at the top thereof to the front edge of a top wall member of said casing structure for selectively opening and closing said access opening by the application of upwardly pulling and downwardly pushing forces to said door, respectively, said door being formed with a substantially outwardly concaved cavity which cooperates with said cavity of said casing structure to define said heating chamber when said door is in position to close said access opening; means for locking said door in the closed position; means for preventing said microwaves from leaking from around said hingedly supported door during closure of said door; and means for biasing said door towards an opened position.

2. A microwave oven as claimed in claim 1, wherein said biasing means comprises a door arm having one end pivotally connected to said door, a roller rotatably mounted on the other end of said door arm, a support block having an inclined surface on which said roller rests, and a spring element disposed between said door arm adjacent said roller and a fixed position of the casing structure, said roller rolling up and down as said door is opened and closed, respectively.

3. A microwave oven as claimed in claim 2, wherein said inclined surface of said support block is formed with an inwardly rounded recess for trapping said roller during movement of said door between the closed and opened positions to permit said door to halt in a substantially half opened condition.

4. A microwave oven as claimed in claim 1, wherein said door locking means comprises a door handle pivotally supported by said door for movement between locked and released positions, a pair of latches each supported by said door for movement between projected and retracted position, said latches being moved to said retracted position as said door handle is pivoted from said locked position to said released position in readiness for opening of said door, and a door switch adapted to be actuated by said latche.

5. A microwave oven as claimed in claim 1, wherein said microwave leakage preventing means comprises a microwave absorbent element arranged on the casing structure at a portion where said door contacts during closure thereof, said door and said casing structure being formed at the front with stepped panels which are similar in sectional shape to each other.

6. A microwave oven as claimed in claim 5, wherein a microwave absorbent element is disposed between said stepped panels.

7. A microwave oven as claimed in claim 2, wherein said roller is adapted to move along a guide rail, said guide rail being provided with a stopper defining the opened position for said hingedly supported door.

8. A microwave oven having a magnetron assembly which radiates microwaves into a heating chamber, which comprises a casing structure having an access opening leading into a cavity defined by said casing structure; a hingedly supported door hinged at the top thereof to the front edge of a top wall member of said casing structure for selectively opening and closing said access opening by the application of upwardly pulling and downwardly pushing forces to said door, respectively, said door being formed with a substantially outwardly concaved cavity which cooperates with said cavity of said casing structure to define said heating chamber when said door is in position to close said access opening; and means for preventing said microwaves from leaking from around said hingedly supported door during closure of said door, said microwave leakage preventing means comprising a first microwave absorbent element arranged on at least either of said casing structure and said door at a portion where said casing structure and said door contact to each other during closure of said door, and a second microwave absorbent element positioned within a space formed between a door handle and said door, said second absorbent element extending in parallel relation to a flange portion at the front of the heating chamber.

* * * * *